United States Patent [19]

Marrero

[11] 4,166,934

[45] Sep. 4, 1979

[54] MODULAR ELECTRICAL SWITCH/OUTLET ASSEMBLY

[76] Inventor: Louis Marrero, 1209 Via Ramon, Escondido, Calif. 92025

[21] Appl. No.: 934,062

[22] Filed: Aug. 15, 1978

[51] Int. Cl.[2] ..... H01R 13/70

[52] U.S. Cl. ..... 200/51 R; 174/55

[58] Field of Search ..... 200/51 R, 51.02; 174/53, 55

[56] References Cited

U.S. PATENT DOCUMENTS 4,103,125 7/1978 Marrero ..... 200/51 R

*Primary Examiner*—Houston S. Bell

[57] ABSTRACT

A modular electrical switch/outlet assembly is provided which contains an easy-to-wire wiring box which articulates contact pairs in the form of sockets for bayonet type prongs so that the wiring box will accept alternatively either an electrical outlet module or a switch module, both of which are provided with a pair of connector prongs to mate with the wiring box. All of the parts and sub-assemblies are so constructed that they can be dismantled entirely so that only the elemental parts need be replaced in case of breakage rather than requiring replacement of the entire unit or major subassemblies.

24 Claims, 22 Drawing Figures

FIG. 13
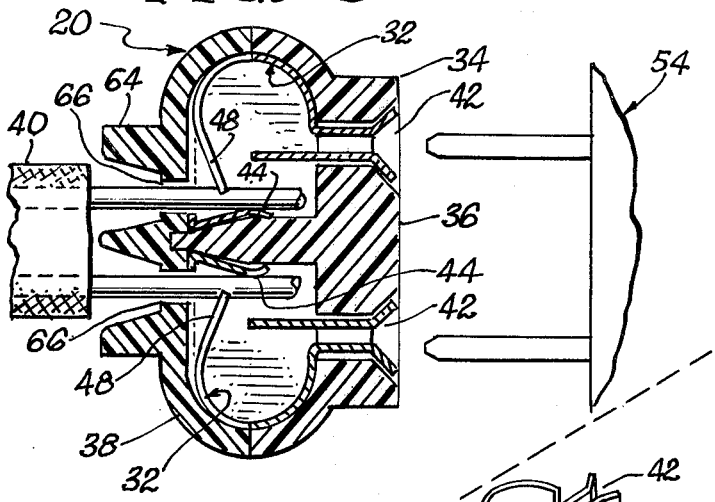
FIG. 14
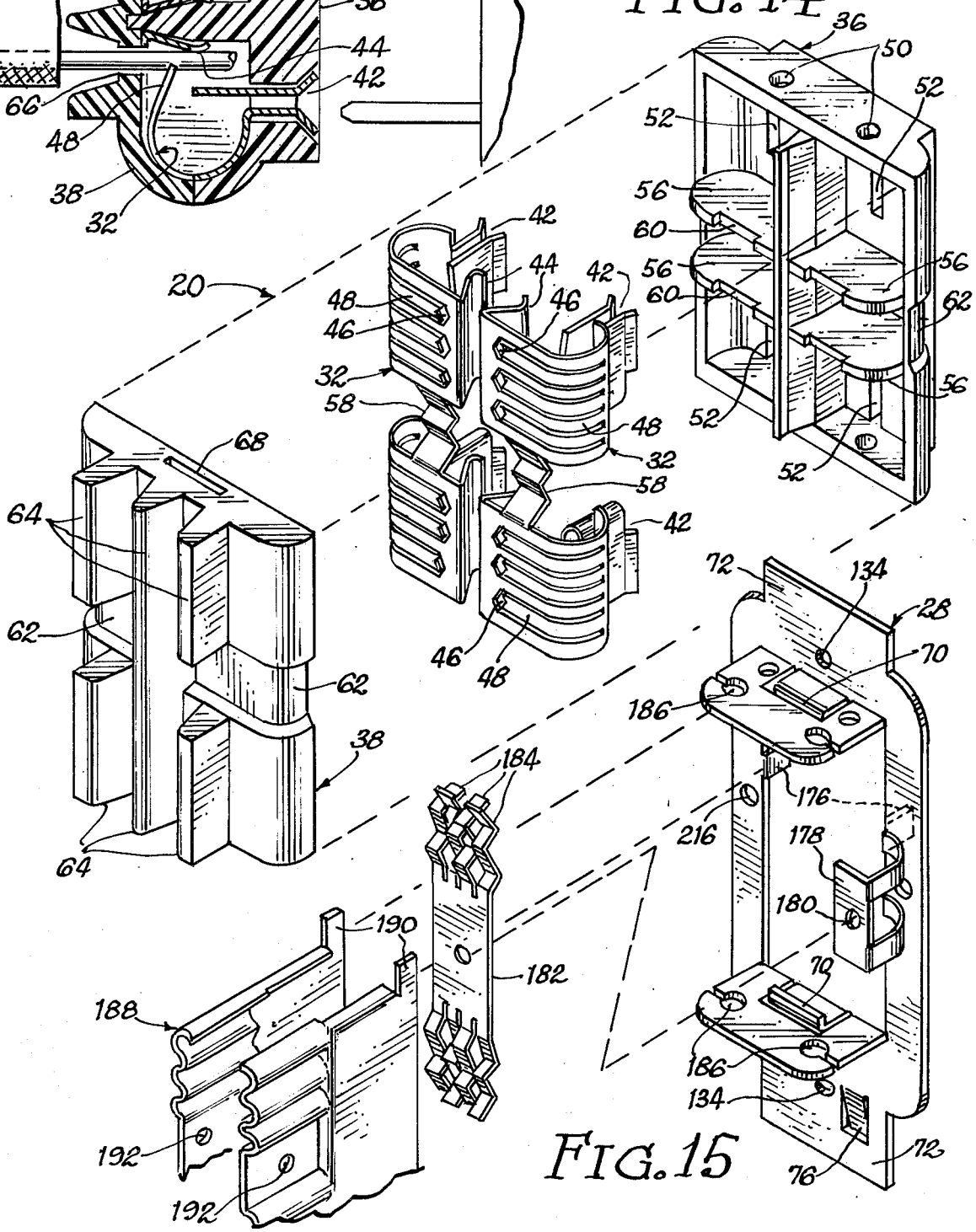
FIG. 15

128
130
94
110
128
96
128
130
94
110
128
96
30
114
120
118
116
120
124
126
122
136
108
92
112
136
120
104
126
120
126
138
138
90
138
104
118
116
92

96
94
128
98
100
106
130
106
102
110
130
128

FIG. 18
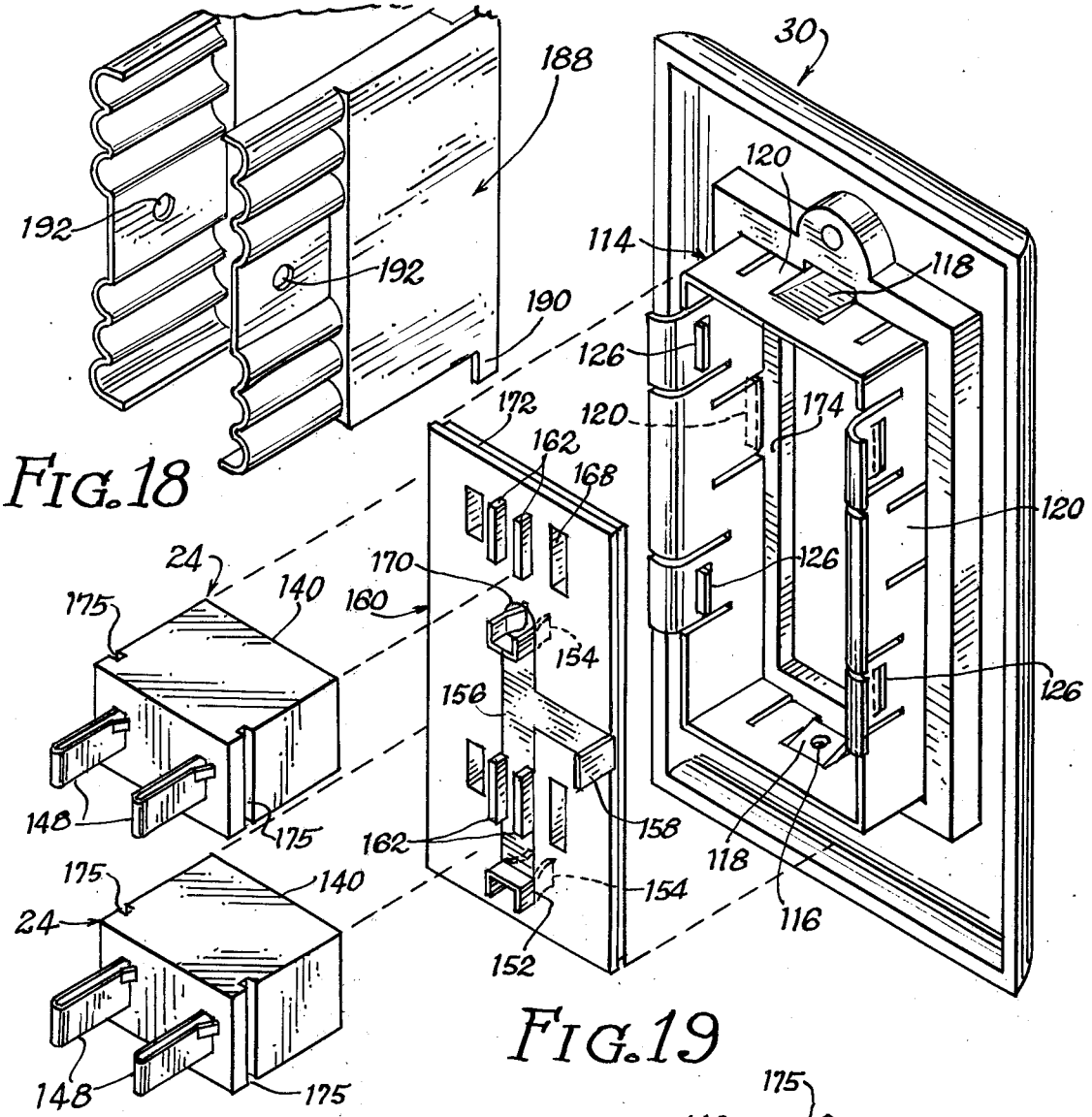
FIG. 19
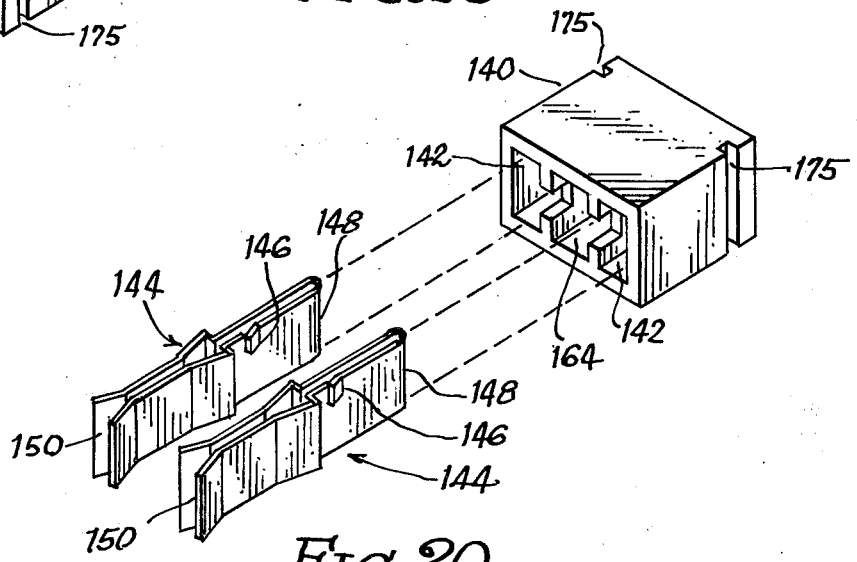
FIG. 20

MODULAR ELECTRICAL SWITCH/OUTLET ASSEMBLY

BACKGROUND OF THE INVENTION

This invention represents a switch outlet assembly having a number of refinements over a forerunner unit disclosed in U.S. Pat. No. 4,103,125. The same basic concept of utilizing modular switch and outlet units is carried forth from the earlier unit, but the improved units of the instant disclosure are easily dismantleable and are designed with an eye toward mass production manufacturing techniques.

SUMMARY OF THE INVENTION

The assembly of the present invention provides a basic structure which can be utilized either for a pair of electrical outlets, a pair of switches, a single switch having double amperage capacity, or a pair of switches having a single pole, double throw mode of operation, characteristic of switches used in dual control light arrangements.

The electrically functioning sub-assemblies are three in number, the first being a specially designed wiring box which is common to the other two principal sub-assemblies, the latter being either the switches or the electrical outlets. These sub-assemblies are all designed to be very simply dismantled to facilitate repair, and are very simple to assemble in whatever configuration is desired.

In addition to the three main electrical sub-assemblies, novel mounting structure is provided facilitating the ease of assembly and disassembly as well as optimizing the possibilities for use of straight-forward manufacturing techniques.

BRIEF DESCRIPTION OF THE DRAWINGS

FIG. 13 is horizontal section showing a detail of the wiring box and the connection of the wires thereto;

FIG. 14 is an exploded perspective view of a wiring box;

FIG. 15 is an exploded perspective view of the mounting plate showing the cable gripper gates and the ground wire clip;

FIG. 18 is a fragmentary perspective view of the cable gripping gates;

FIG. 19 is an exploded perspective view of the first embodiments of the outlet modules, positioning plate and facia plate;

FIG. 20 is an exploded perspective view showing the construction of a single outlet module of FIG. 20;

DETAILED DESCRIPTION OF THE PREFERRED EMBODIMENTS

Figure 1:
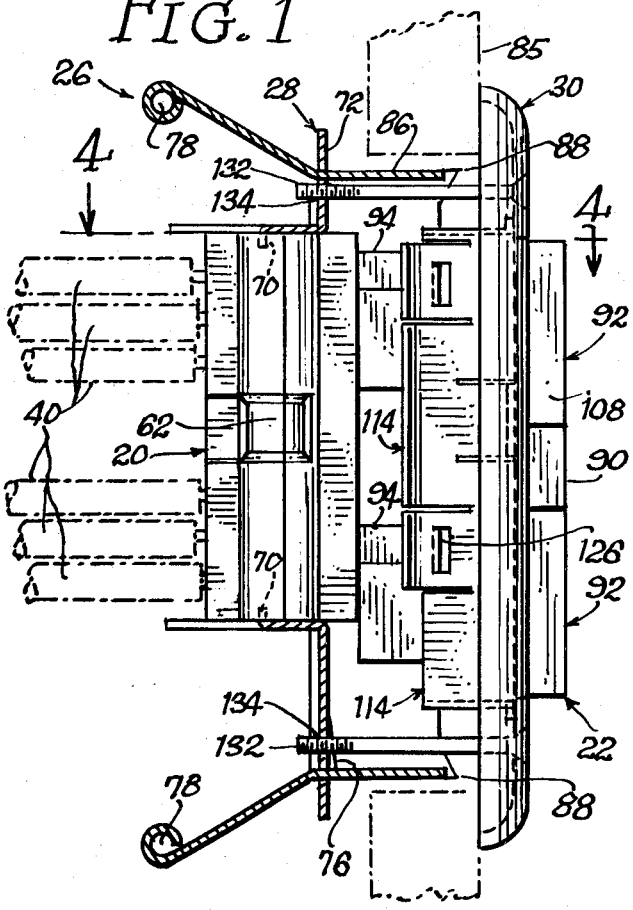
FIG. 1 is a view of the right side of the assembly with portions in section.
Figure 2:
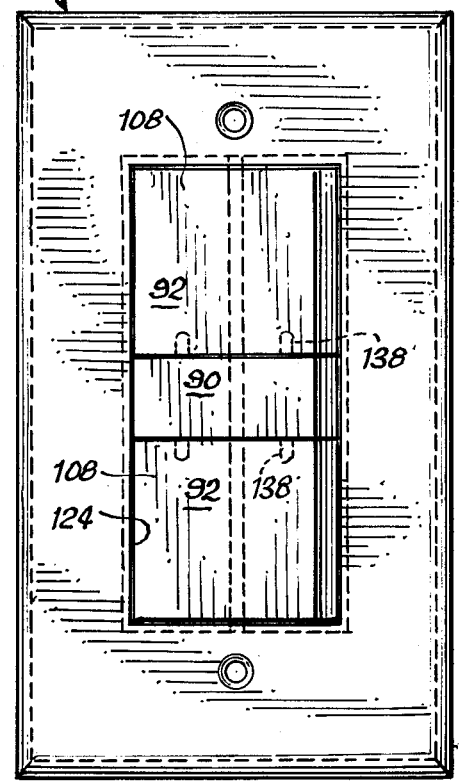
FIG. 2 is front elevation view of the assembly utilized as a single switch.
Figure 3:
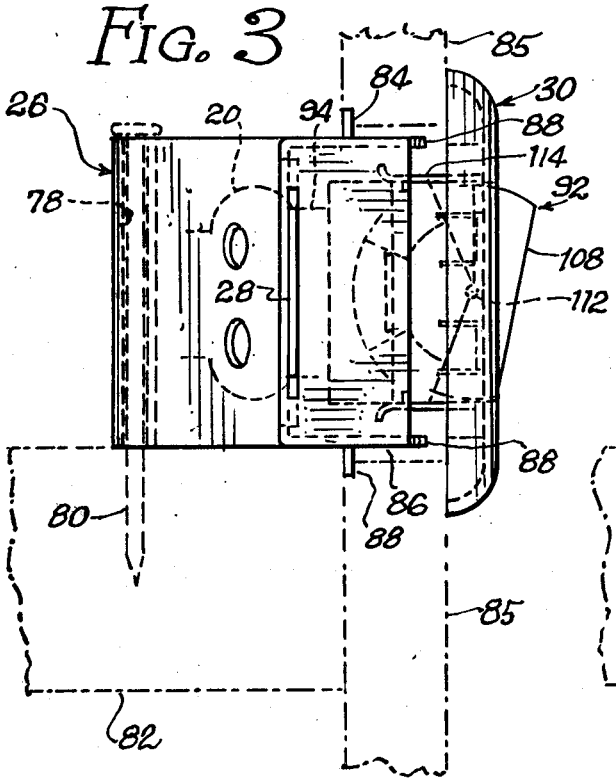
FIG. 3 is top view of the assembly shown in FIG. 1.
Figure 4:
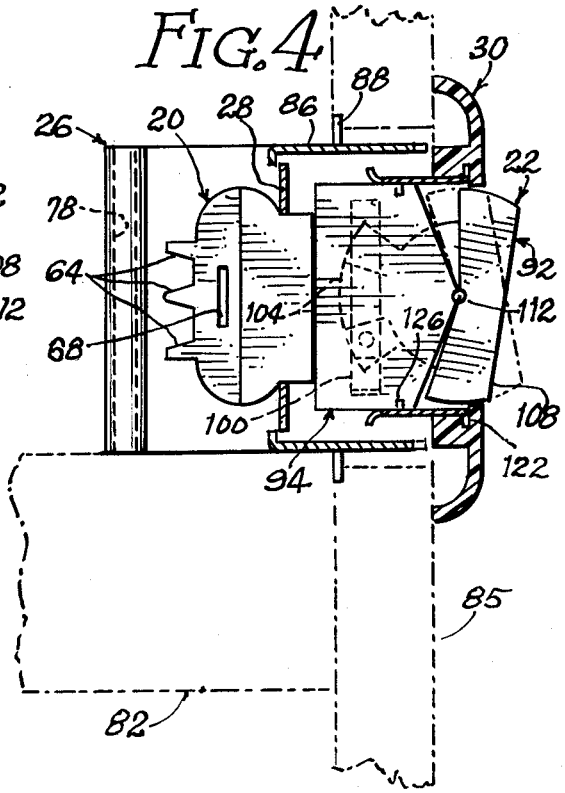
FIG. 4 is a section taken along lines 4—4 of FIG. 1.
Figure 5:
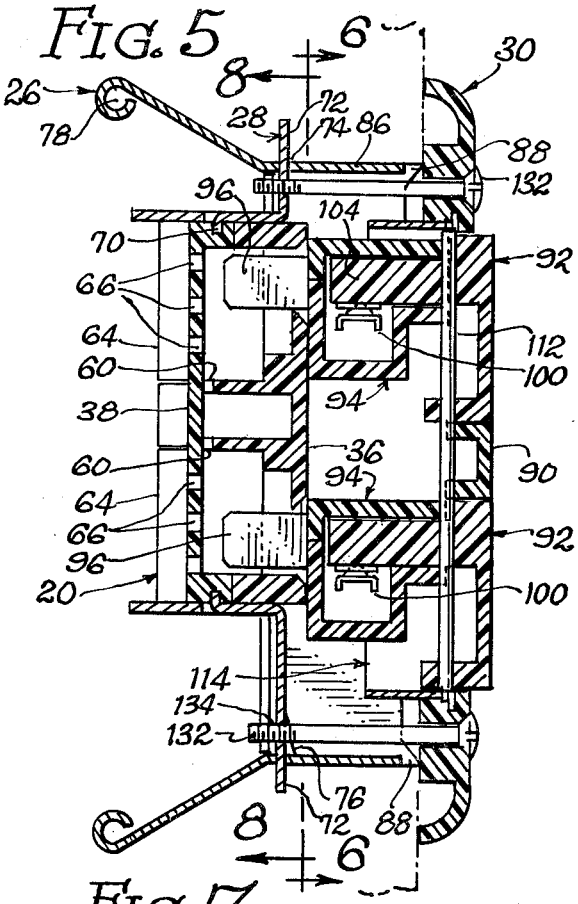
FIG. 5 is a vertical section taken longitudinally and centrally of the assembly shown in FIG. 1.
Figure 6:
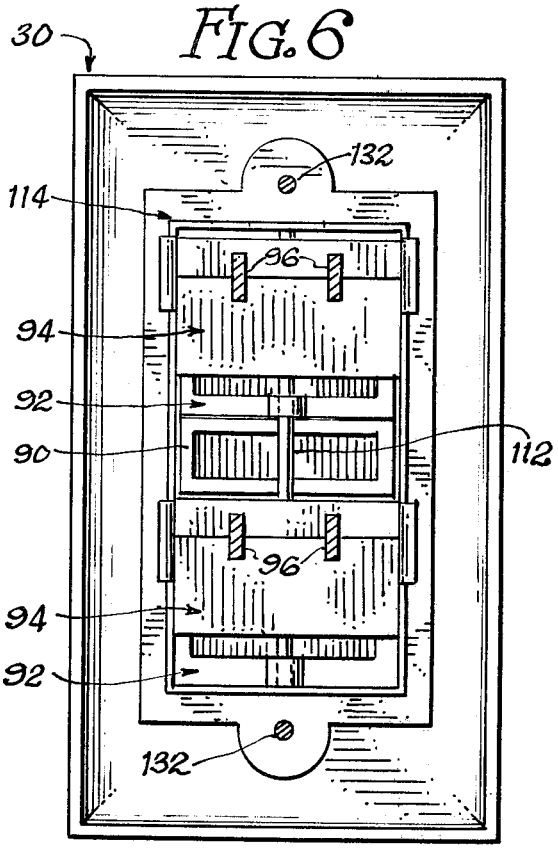
FIG. 6 is a section taken along lines 6—6 of FIG. 5.
Figure 7:
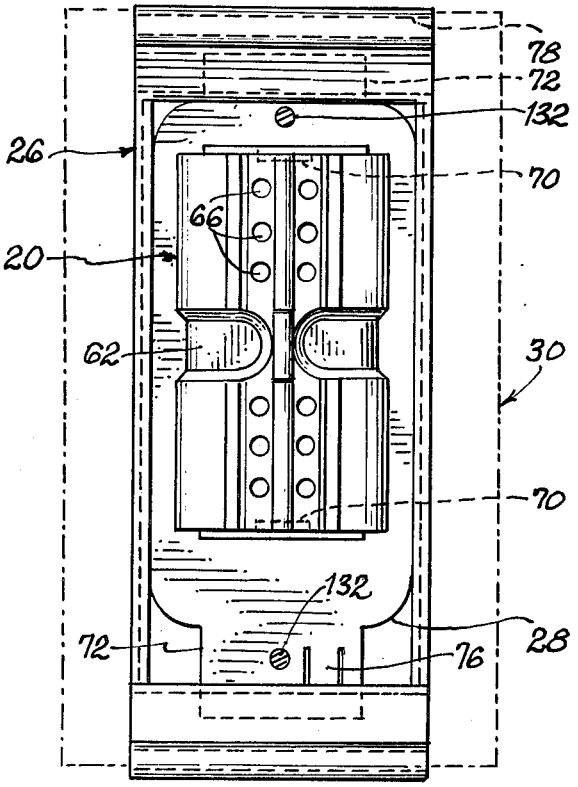
FIG. 7 is a rear elevation view of the assembly showing portions in phantom.
Figure 8:
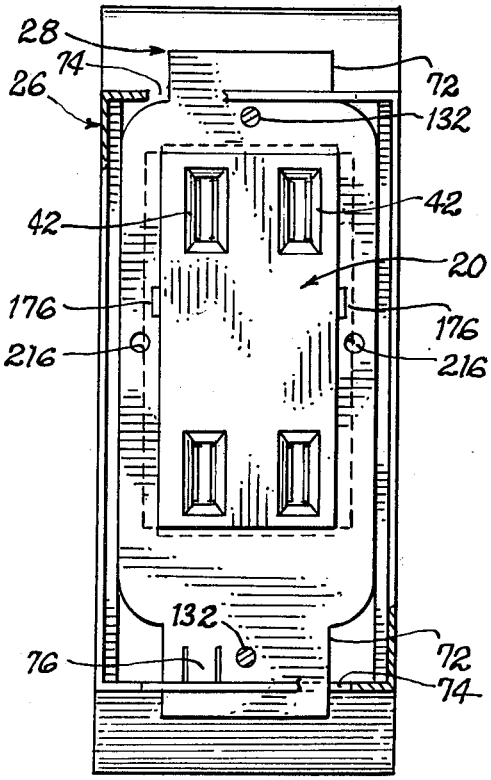
FIG. 8 is a section taken along lines 8—8 of FIG. 5.

To most simply understand the invention, it is best to visualize it as having three electrically functioning sub-assemblies, and the remaining structure is mounting structure. The first sub-assembly is the wiring box 20 shown in detail in FIG. 14. As is seen in FIG. 13, the wiring box is wired from the left and provides bayonet sockets on the right. It is common to all embodiments and is used with both of the other sub-assemblies.

The other two sub-assemblies are used alternatively with the wiring box. The first is a switch sub-assembly shown in FIG. 16 at 22. The bayonet terminals of the switch sub-assembly 22 are received in the sockets of the wiring box. If it is desired to provide an electrical outlet, the third sub-assembly, best shown in its two embodiments in FIGS. 19 through 22, comprises electrical outlet modules 24 and 25 which are individually plugged into the sockets provided by the wiring box.

The remaining structure is support structure. A somewhat standard looking bracket 26 is nailed to a building stud behind the wall board, and a mounting plate 28, best seen in FIG. 15, is engaged in the mounting bracket 26. The wiring box 20 is clipped into the central opening of the mounting plate, and bolts compress the remainder of the structure between the facia plate 30 shown in FIG. 16 and the mounting plate.

IN DETAIL

Turning to the wiring box 20, best shown in FIGS. 13 and 14, it can be seen that this sub-assembly has a pair of inner conductive elements 32 housed in a non-conductive plastic casing 34 which has a front portion 36 and a rear cover 38. It is the purpose of the wiring box to mount the ends of Romex cables 40 and provide conductor means from these cables to sockets 42 in the front 36 of the plastic casing. Contact is made with the stiff monofilaments of the romex by means of leaf spring members 44 formed in the conductive element 32. The monofilaments pass through openings 46, each of which is defined on one side by an elongated leaf spring 48 which is biased forward by the insertion of the monofilament so that it bears on the monofilament and holds it in place against 44 and the fixed side of the opening 46. Openings 50, positioned in the top and bottom of the plastic casing member 36, can be used to insert a common nail to release the monofilaments if so desired.

It can be easily visualized from FIG. 14 that the conductive elments fit snugly within the front part of the casing 34 such that the metallic sockets 42 register with slotted openings 52 so that a sub-assembly, generally indicated at 54, can be received in the wiring box as shown in FIG. 13. The sub-assembly could be either the switch 22 or outlets 24,25 and are referred to in the claims as "electrical utilization means," which is hereby defined as any sub-assembly which could beneficially be used in conjunction with the wiring box as described in the application.

Turning once again to the conductive elements 32, it can be seen that dividers 56 conveniently divide the casing into upper and lower portions into which seat upper and lower portions of the two conductive elements 32. A W-shaped connector 58 joining the upper and lower portions of each conductive element seat in the slots 60 articulated in the dividers 56, it being the intent that in order to achieve complete independence of operation between upper and lower sockets, these frangible portions of the conductive element can be broken with a pair of needle-nosed pliers. To enable this operation to be effected after enclosure of the conductive elements within the plastic casing, a band of thin-walled, frangible plastic 62 is molded in the plastic casing. Ribs 64 molded into the back 38 of the plastic casing aid to segregate the monofilaments inserted on either side of the central rib and cooperate with cable gripping structure as described hereinafter. Between the ribs of course are holes 66 registering with the holes 46 in the conductive elements to accommodate the Romex monofilaments.

Figure 9:
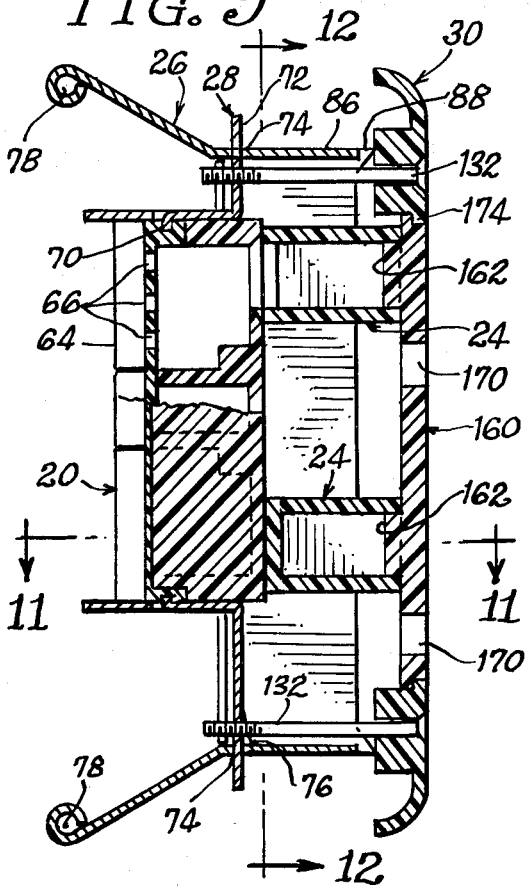
FIG. 9 is a vertical longitudinal sectional view of the assembly in its electrical outlet mode of use.
Figure 10:
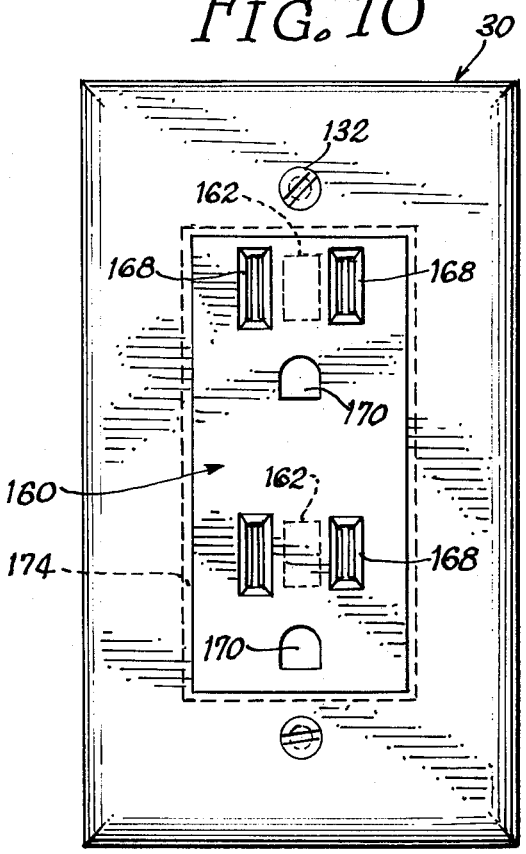
FIG. 10 is front elevation view of the unit of FIG. 9 as it appears installed in a wall.
Figure 11:
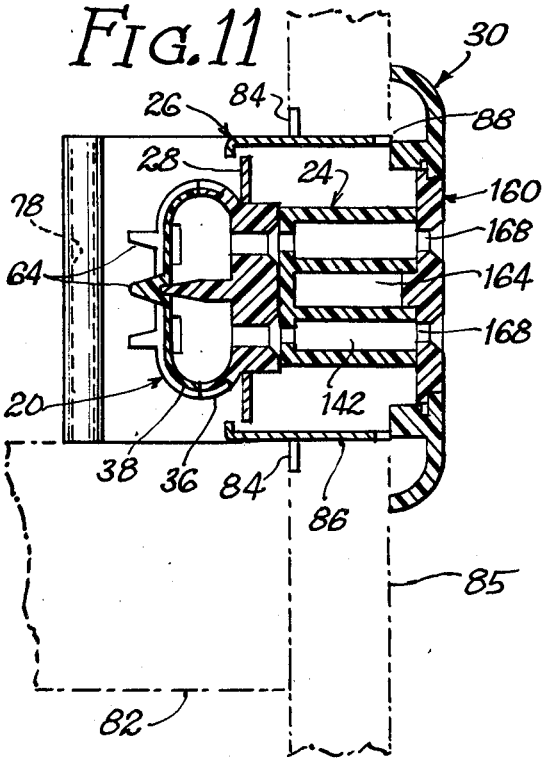
FIG. 11 is a section taken along lines 11—11 of FIG. 9.
Figure 12:
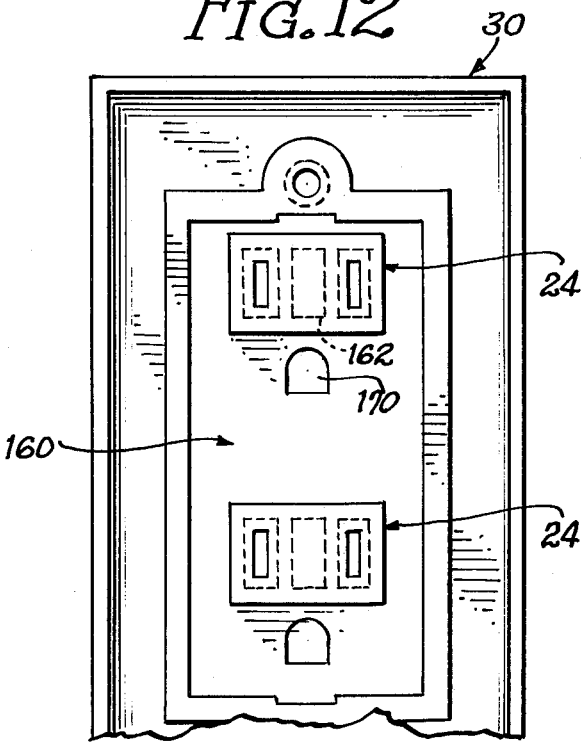
FIG. 12 is a sectional view of the embodiment of FIG. 9 taken along lines 12—12.

The wiring box is securely but removably attached to a building stud behind the wall board of the building by means of the following structure. Slots 68 provided in the top and bottom of the plastic casing 34 are engaged by spring tabs 70 which are inwardly directed from opposite edges of the central opening defined in the mounting plate 28, best shown in FIG. 15. This mounting plate has top and bottom tabs 70 which are engaged in slots 74 defined in horizontal panels in the mounting bracket 28, as can be seen in FIG. 9. Insertion of the mounting plate is effected by depressing the spring detent 76 and slipping the bottom tab through the bottom slot, and then engaging the top tab by bringing the plate upward until the detent snaps out into final position as can be seen in FIG. 1. Ordinarily the mounting plate 28 would capture the wiring box and be engaged in the mounting bracket at the point of manufacture.

The mounting bracket itself provides a pair of openings 78 through which nails 80 pass into a building stud 82. The nails would ordinarily be friction-held in the openings as the bracket comes from the factory. A positioning tab 84, provided on both sides of the mounting bracket for left or right-hand mounts, automatically achieves proper positioning of the mounting bracket on the stud so that it is quickly placed against the stud and hammered into permanently mounted relation. Wall board 86 is applied over the front of the stud, and to accommodate thicknesses which may vary, more than one set of slots 74 may be provided in closely set parallel relationship in the top and bottom of the mounting bracket.

The mounting bracket has a rectangular side panel defining member 86, the forward corners of which define points 88 to facilitate the marking of uncut wall board with the exact position in which the hole must be cut to expose the assembly. The rectangular side panel 86 also provides a protected box-like enclosure for the electrical assembly.

Figure 16:
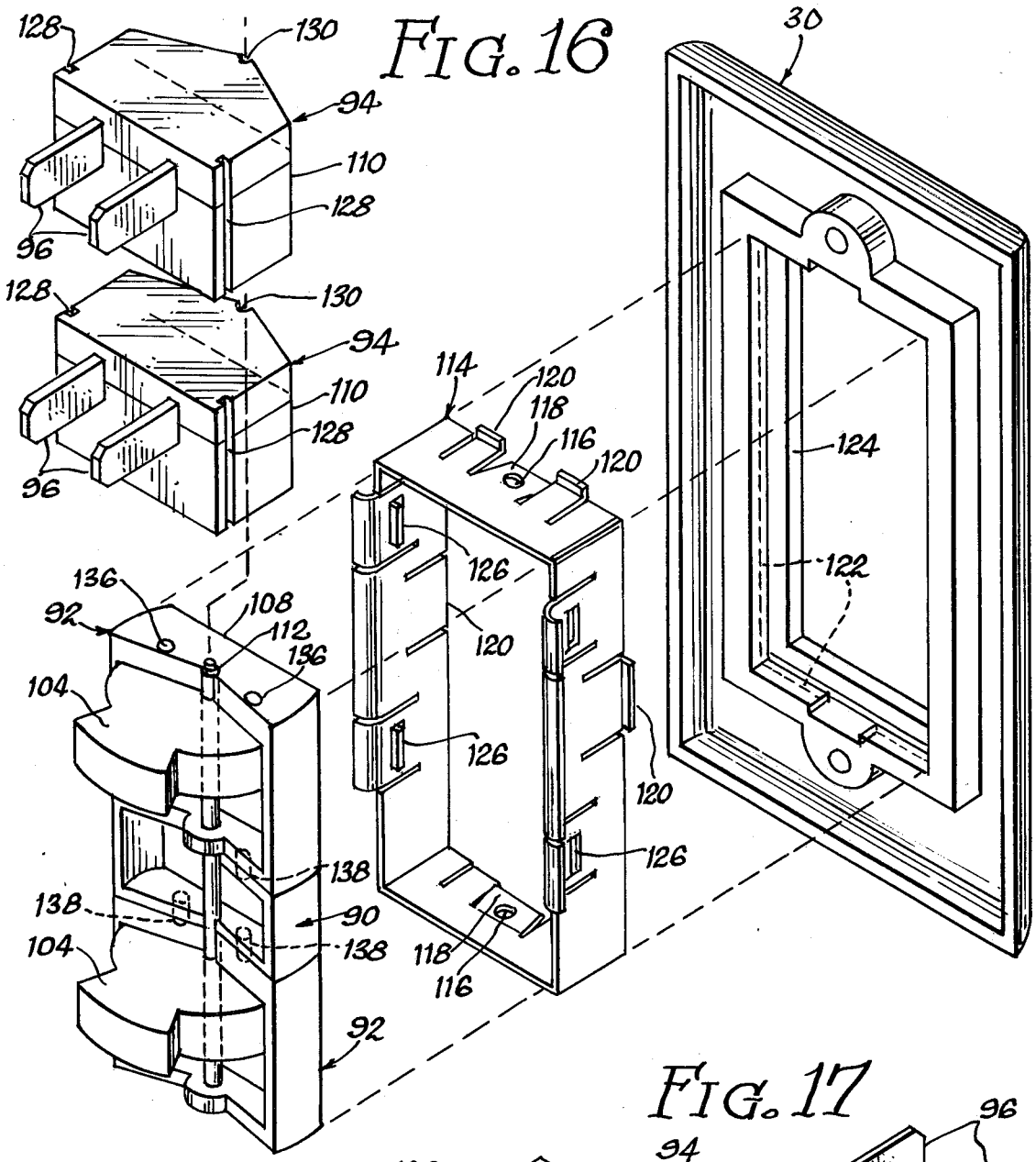
FIG. 16 is an exploded perspective view of the assembly used in its switch embodiment.
Figure 17:
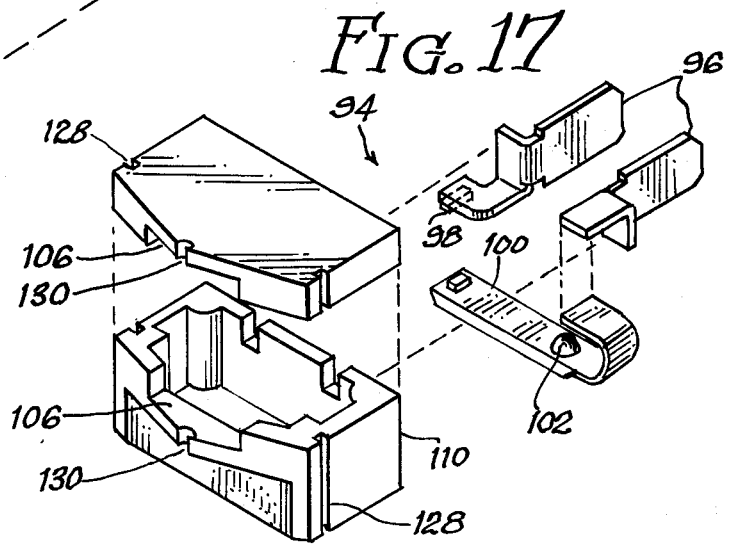
FIG. 17 is an exploded view of the stationary portion of a switch module.

Thus the wiring box 20 is mounted by means of the mounting plate 28 and the mounting bracket 26 securely to the building stud such that the sockets 42, both top and bottom, face forward and are available to receive a utilization means such as a switch or an outlet. A switch 22 is shown in FIGS. 16 and 17 in exploded detail. The switches are ordinarily provided in a vertical stack of two separated by a spacer 90. Each switch module 22 has two parts, a toggle portion 92 and an electrical contact portion 94.

The contact portions 94 each have a pair of bayonet prongs 96 which engage in the sockets 42. The interior of this element is shown in FIG. 17 where it can be seen that the bayonets 96 are part of the interior electrical contact structure, there being one stationary contact 98 and one movable contact 100 which is on the end of a spring arm formed by the conductor. The two pieces of the movable contact which are shown are of course integral, their being exploded for the purpose of illustration only. The two contacts, i.e. the stationary and the movable contact, are ordinarily touching and thus completing the circuit through the bayonets 96, but the circuit is opened by depressing the movable contact 100. In order to allow this, a small raised knob 102 is provided on the movable contact, and this knob is depressed by the lateral movement of cam member 104 which is part of the toggle portion 92 of the switch.

The toggle passes through the opening 106 articulated in the forward face of the element 94.

Each of the toggle elements 92 is a single, unitary unit the forward face of which, indicated at 108, is manipulated by the user and acts as the toggle. Thus by pushing the right or left side of the face 108, cam element 104 is caused to move inside the plastic casing 110 which houses the electrical contact elements. The toggle portion of the switch is journalled on a spindle 112, and the spindle in turn is mounted in a retainer 114. This is achieved by snapping the exposed ends of the spindle into holes 116 provided on spring tabs 118 of the retainer.

The retainer is in turn mounted in facia plate 30 by means of outwardly directed spring tabs 120 which engage in a groove 122 formed in the interior of the opening 124 defined by the facia plate. The retainer is simply inserted into this opening and the tabs 120 snap into engaging relations with the groove 122 of the facia plate.

Once the toggle portions 92 together with the spacer 90 are inserted in the retainer 114, the contact housing portions 94 of the switch modules can be inserted into the rear of the retainer such that inwardly directed spring tabs 126 engage in the grooves 128 molded into the sides of the plastic casing 110. As these units are snapped into position, concave portions 130 serve to retain the spindle in position.

It can thus be seen that the retainer 114 mounts the toggle portion 92 of the switch modules in such a way to permit rotation about the mounting spindle, whereas the rear contact portions 94 are immovably mounted by means of the tabs 126, so that upon manipulation of the front surface 108 of the toggle plate, the cam 104 of each switch module moves back and forth within the casing 110 to cause the moving contact 100 to alternately make and break the circuit.

The entire assembly just described including the retainer, facia plate and switch modules are mounted, as is seen in FIGS. 1 through 4, by means of a pair of bolts 132 which pass from the facia plate clear through to the threaded holes 134. This sandwiches the switch structure between the mounting plate 28 and the facia plate with the bayonets 96 engaged in the sockets 42. Thus the electrical appliance or light fixture controlled by the switch is wired through the wires exiting the wiring box at the rear.

Turning again to further details of construction of the switch module as shown in FIG. 16, each of the toggle portions of the module is identically made having pin sockets 136, which are simply bores through the plastic, provided in both the top and bottom panels. This duplicity enables each module to be used as either the top or the bottom module in a vertical stack and still have the pins 138, which extend up and down from the spacer 90, engaged in them. It will be noted that while this spacer is so engaged, both the top and the bottom switch module will move concomitantly.

The purpose of concomitant switch movement is to permit wiring of both switches to the same appliance to permit double current carrying capacity. In another configuration, the lower contact portion is mounted upside down with respect to the upper section. When the toggle is now actuated, the switch arms will open and close alternately in opposite fashion so that when the upper circuit 16 open, the lower circuit will be closed. This action is identical to a conventional single-pole, double throw switch used to provide dual switching stations to a single light.

If it is desired to use the switch modules separately, the spacer is also provided with vertically aligned bores slightly forward of the position occupied by the spindle in FIG. 16. This permits the spacer to be moved back slightly by inserting the spindle through the just-described bores, thus bringing the pins 138 rearedly of the sockets 136 so that they are no longer engaged, with the result that top and bottom switch modules are free to move independently, at least within limits (defined by the spacer pins) that are large enough to permit the cam action to be effective.

It should be noted at this point that the front, pie-shaped face of the contact half-modules 94 is shaped at an angle more acute than the rear face of the half module 92, so that about twenty degrees of rotation can occur between the toggle module and the stationary portion 94. This obviously is adequate to insure proper operation of the cam 104 inside the casing 110.

Turning now to the first embodiment of the electrical outlet modules 24 utilized when the unit is in operation in its outlet mode, each module has a plastic casing 140, most easily visualized from FIGS. 19 and 20. This casing has channels 142 into which are inserted elements 144 such that they project through openings in the rear of the casing 140 as shown in FIG. 19. Detents 146 prevent the escape of these contact elements once they are inserted.

The rear ends of these elements 144 define the bayonets 148 which are received in the sockets 42 of the wiring box, and the front ends are shaped to define the female contacts 150 of an ordinary electrical outlet.

The "hot" plug receptacles are provided by the switch modules proper, and grounding connections for three-pronged plugs are accommodated through the openings 152 in the positioning plate 160. These openings house terminal clips 154 which are part of a stamped metal grounding strap 156 which is mounted in a molded channel 157 in the positioning plate 160. The grounding strap could be hot-pressed into the plastic during the molding process. A spring contact 158 projects rearedly from the end of an arm centrally extended from the main body of the strap, and grounds the ground-prong sockets as will be described.

Each of the outlet elements 24 is mounted on a positioning place 160 which defines two pairs of ribs or keys 162 which fit into central key ways 164 which are defined between the channels 142 in the casing 140. These keys position and stabilize the outlet elements such that the plug receptacle elements 148 register with the openings 168 in the positioning plate, and the bottom set of ribs 162 captures the lower portion of the grounding strap 156. Note that once the lower outlet module is positioned and engaged by the retainer, the grounding strap is sandwiched between that module and the positioning plate with tabs 126 in slots 175.

It can be seen in FIG. 19 that the positioning plate 160 is formed from a planar panel 170 having a stepped shoulder 172. This stepped shoulder fits snuggly into mating structure 174 in the facia plate, and once again, as was the case with the switch mode of assembly, the facia plate is mounted by means of bolts 132 which engage the mounting plate 28. Before these bolts are tightened down completely, as has been indicated above, the mounting plate may be twisted or swiveled slightly to insure it is rectilineally arranged with regard to the vertical and horizontal prior to final tightening.

Turning now to the current pathway between the grounding strap 56 and a ground wire, the rearwardly directed spring contact 158 slides into contact with the right-hand one of the forwardly extended ears 176 which project from the mounting plate 28, as can be seen in FIG. 15. A mounting arm 178 extends from the side of the mounting plate and has a threaded screw hole 180 to which is mounted a ground wire clip 182. This clip has a number of zig-zag fingers 184 which will engage a wire which is slipped from the ends of the fingers inwardly toward the central portion. It will be noted that when properly inserted, several ground wires can be consecutively inserted and each one will serve to further secure the prior wires.

Another feature of the mounting plate is the pair of circular holes 186 which have access slots to the edge of the metal in which they are formed. A pair of cable clamping gates 188 are each provided with ears 190 which can be slipped in from the sides into the openings 186 and then brought back to a rearwardly extended position to grip a vertical stack of six cables such as that shown in FIG. 1. The central holes 192 in the gates permit the engagement of screws therebetween to join the gates together, thus firmly securing the cable stack.

Figure 21:
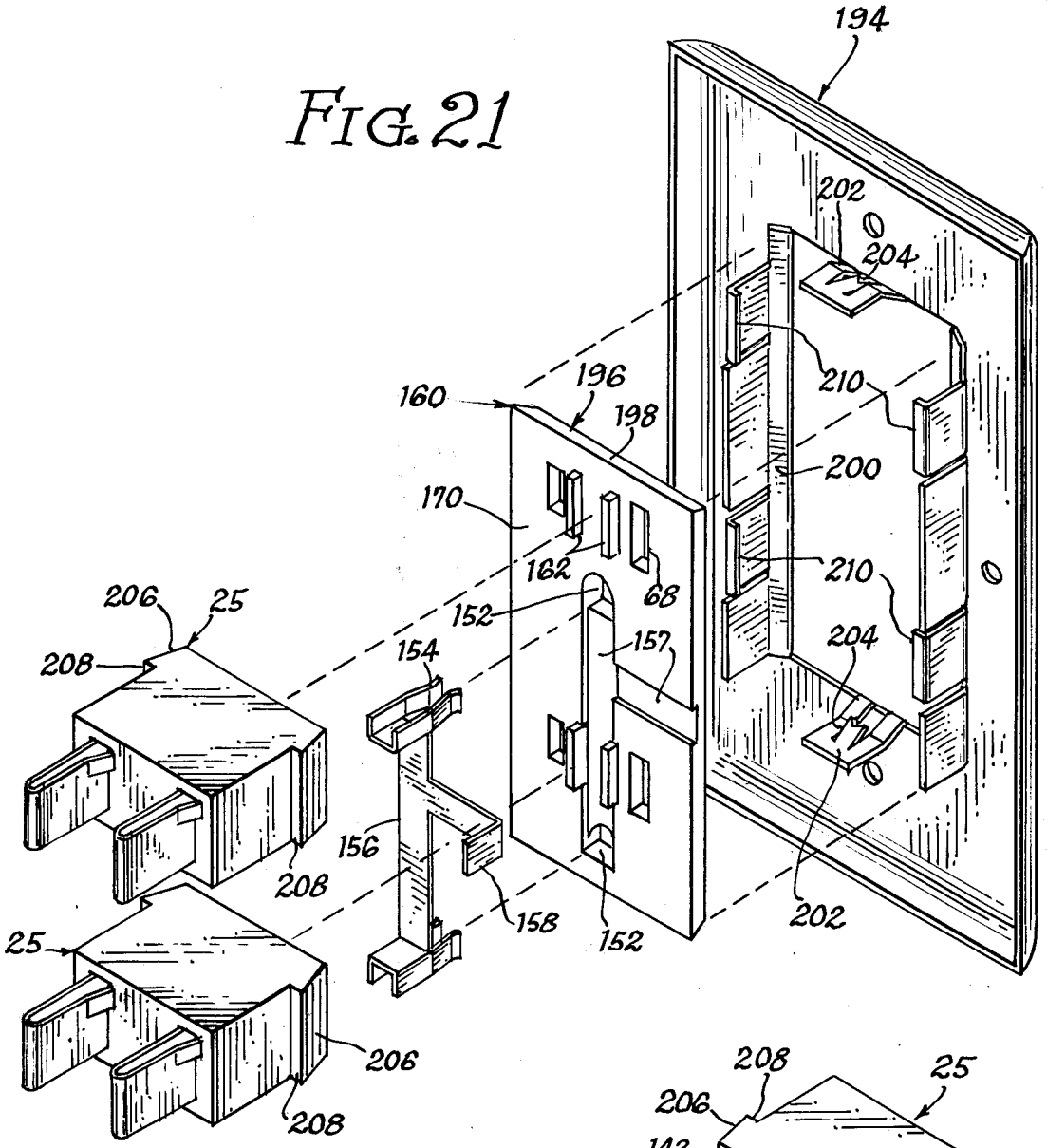
FIG. 21 is an exploded perspective view of a second embodiment of the module, positioning plate and facia plate.
Figure 22:
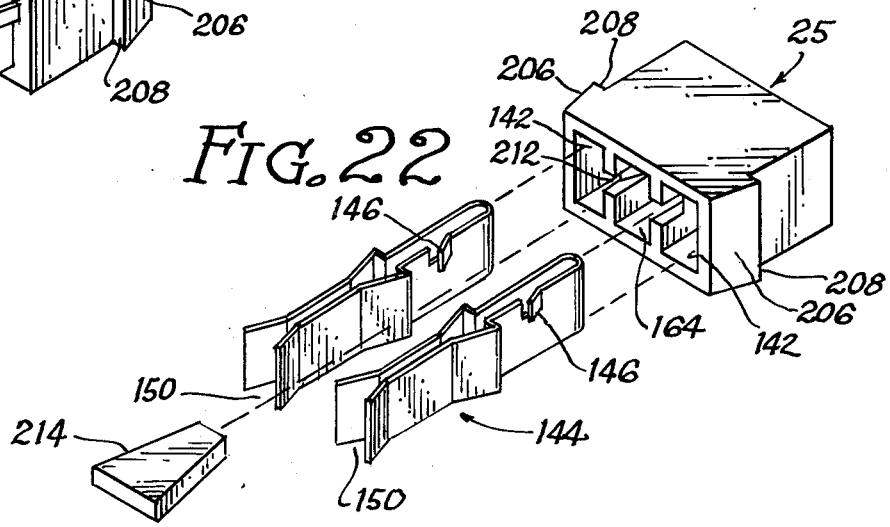
FIG. 22 is an exploded perspective view of the outlet module of FIG. 21.

A modified embodiment of the facia plate and outlet module structure is shown in FIGS. 21 and 22. In this embodiment, a different, preferably stamped metal facia plate 194 incoporates rearwardly extending gripping structure which replaces the retainer element 114 used with the previously described embodiment of facia plate. A positioning plate 196 having a beveled edge 198 fits in the mating angulated seat 200 and is retained in this position by top and bottom spring clips 202, and more particularly the central indented fingers 204 of these spring clips. These fingers are indented because the facia plate 194 can be utilized to replace both the facia plate 30 and the retainer 114 in the switch embodiment, in which case the indented fingers 204 replace the holes 116 in the tabs 118, used in that embodiment to engage the free ends of the switch rocker spindle 112.

The positioning plate being thus mounted, receives, or has received in molded relationship, the grounding strap 156, and the key-defining ribs 162, already described, seat the modified outlet elements 25. These elements have an enlarged front end with sloped sides 206 defining shoulders 208 which are engaged by the spring clips 210 to press the outlet modules firmly against the positioning plate.

The elements 144 of the outlet modules have been described and are not modified, but the key way 164 of each module has a horizontal slot 212 indented in the walls which define it so that a wedge member 214, when inserted into the slot, compresses those portions 150 of the metallic elements 144. The purpose of this is to permit utilization of the assembly as a ceiling light fixture mount or the like. In this capacity, a standard chandelier mount, which is mounted by two bolts or screws, is engaged in the lateral holes 216 of the mounting plate shown in FIG. 15. In this embodiment the facia plate 194 and positioning plate 196, together with the grounding strap, are omitted from the application so that the front faces of the modified outlet modules 25 are exposed.

These light fixtures typically have "pigtails," which are a pair of short multi-strand wires. The ends of these wires are inserted into the receptables 150 and wedged tightly into place by means of the wedge 214 to enable the operator to very simply make a light fixture mounting.

It can thus be seen that in any type of wall or ceiling electrical mounting that is desired, be it one switch, two switch, double switch, single-pole-double through switch, outlet, or light fixture mounting, the assembly described herein can be used. This enormous versatility is of a tremendous economic advantage because even though a few extra mass-produced parts need be provided in a single package to accommodate all applications, the inventory costs are slashed along with the accompanying costs involved in separately ordering, sorting, and explaining several different devices used for several different purposes.

In addition to its versatility, the entire assembly is easily manufactured as its component elements, which constitute metal stampings, small inexpensive plastic molded parts, and off the shelf fasteners.

In addition, the assembly is especially advantageous from the point of view of repair because every element is simply isolated and replaceable. For example, referring to FIG. 16, often the contacts of the switch will wear out after a period of use, which ordinarily requires the replacement of the entire switch when a conventional unit is used. However, by the use of the assembly described herein, only the contact portion 94 of the switch need be replaced, or for that matter, one could actually replace only the contacts themselves. The same is true for the rest of the elements that constitute the combination described and claimed herein.

Finally, it will be noted tht the entire structure and its sub-components described above have been tailored through numerous generations of development specifically to the needs of installing electricians. The unit is easily mounted to a wall stud by two swift strokes of the hammer, and wiring is accomplished in absolutely the simplest way possible by simply inserting the wires through rear facing apertures in the wiring box. Everything is retained in sandwiched relation by means of two bolts 132, requiring only a few brief twists of a screwdriver to mount the entire assembly.

I claim:

1. A modular switch/outlet assembly comprising:

(a) a wiring box having a pair of conductive elements with connection means to attach a pair of wires thereto, said conductor elements each having at least one externally accessable contact point for the coupling thereto of an electric utilization means and means to releasibly mount a utilization means in coupled relationship to said conductive elements and in electrical contact with said contact points; and, (b) releasible mounting means to mount said wiring box to a member of a building.

2. Structure according to claim 1 wherein said releasible mounting means comprises a mounting bracket to be nailed to a building stud and a mounting plate releasibly connected to said mounting bracket, said mounting plate having a pair of inwardly directed and biased releasible detents to engage said wiring box.

3. Structure according to claim 2 wherein said mounting bracket includes top and bottom horizontal panels having lateral slots therein, and said mounting plate has tabs narrower than said slots and engageable therein to permit the lateral play of said mounting plate relative to said mounting bracket to permit precise alignment prior to final positioning.

4. Structure according to claim 2 wherein said releasible detents are releasible from the front, and said utilization means is mounted to the front of said wiring box and removably forwardly such that said wiring box is removable from the front from said mounting means.

5. Structure according to claim 1 wherein said wiring box includes a two piece separable insulated casing substantially enclosing said conductive elements.

6. Structure according to claim 1 wherein said utilization means comprises a pair of removeable switch modules.

7. Structure according to claim 6 wherein said switch modules are operated by toggles and said toggles are rotatably mounted on a common spindle.

8. Structure according to claim 7 wherein said switch modules are separable from one another, identical, and invertable to reverse the mode of operation.

9. Structure according to claim 8 wherein said toggles are separated by a spacer, and said spacer has means engaging both of said toggles for concommitant rotation.

10. Structure according to claim 9 wherein said engaging means comprises pegs engaged in sockets defined in said switches, said spacer has a bore engaged on said spindle, and said spacer has an alternative bore for engaging said spindle with said pegs free of said sockets.

11. Structure according to claim 1 wherein said wiring box includes an insulated casing which houses said pair of conductive elements, and said conductive elements articulate an upper set of contact points and a lower set of contact points and each conductive element includes a frangible central portion to permit the electrical isolation of said upper and lower sets of contact points, respectively, and including access means provided in said casing for providing access to said frangible portions for the purpose of breaking same.

12. Structure according to claim 11 wherein said access means comprise thin-walled weakened frangible portions of said casing.

13. Structure according to claim 1 and including a mounting framework mounting said wiring box said connection means receive cables from the rear of said wiring box, and further including a pair of opposed cable gripping gates pivotally mounted on parallel axes and being capable of swinging rearwardly into cable-engaging relationship and including means connected said gates together to grip a group of cables therebetween.

14. Structure according to claim 13 wherein said gates each have a pair of outwardly directed tabs and said mounting framework includes a mounting plate defining a pair of holes having openings to receive said tabs into said holes whereby said gates are pivotally engaged by said tabs in said holes.

15. Structure according to claim 1 wherein said contact points are sockets to receive bayonet-type prongs from a utilization means.

16. Structure according to claim 1 and including a mounting framework and a ground wire clip attached to said framework, said ground wire clip comprising a plurality of generally parallely extended zig-zag parallel fingers to receive successive ground wires therebetween.

17. Structure according to claim 1 wherein said utilization means comprise a pair of electrical outlet modules.

18. Structure according to claim 17 wherein each of said outlet modules comprises an insulation casing having a pair of channels therethrough, and including a pair of elongated conductive clips each defining a female end to receive plug prongs, and said bayonet terminals at the other end.

19. Structure according to claim 17 wherein the female ends of said clips are defined by resilient side panels and said insulation casing has a transverse slot communicating in part with said clip channels and including a wedge receivable in said slot to compress said female ends to capture any multi-filament wire entrained therein.

20. Structure according to claim 17 wherein each of said contact points comprises a socket and each of said outlet modules is provided with a pair of bayonet terminals to seat in said sockets, and further including a positioning plate having keys to engage keyways provided in said modules and a facia plate mounting said positioning plate.

21. Structure according to claim 20 and including a ground strap retained on said positioning plate having ground prong sockets to receive ground prongs from a plug, and including ground wire connection means and a conduction path defined between said strap and said ground wire connection means.

22. Structure according to claim 20 wherein said outlet modules is each provided with a pair of opposite shoulders and said facia plate includes a pair of rearwardly extended resilient clips releasibly engaging said modules.

23. Structure according to claim 20 wherein said facia plate includes a pair of notched spring tabs to alternatively engage said positioning plate or the spindle of a pair of toggle switches.

24. Structure according to claim 1 wherein each of said connection means comprises an opening in one of said conductive elements through which a monofilament wire can be pushed, one side of said opening by fixed and the other shaped to define a yielding leaf spring, and further including a spring member opposite said leaf spring such that a monofilament is captured on one side by said fixed side and spring member and on the other side by said leaf spring.

* * * * *